US005996593A

United States Patent [19]

Horman

[11] Patent Number: 5,996,593

[45] Date of Patent: Dec. 7, 1999

[54] HAIR CLIP

[76] Inventor: Heidi Christine Horman, 104 Rosemary La., Centerville, Mass. 02632

[21] Appl. No.: 09/033,990

[22] Filed: Mar. 3, 1998

Related U.S. Application Data

[60] Provisional application No. 60/052,662, Jul. 16, 1997.

[51] Int. Cl.[6] ..... A45D 8/22

[52] U.S. Cl. ..... 132/278; 132/275; 132/277

[58] Field of Search ..... 132/275, 276, 132/277, 278, 279, 132, 133

[56] References Cited

U.S. PATENT DOCUMENTS

| | | | |
|---|---|---|---|
| 717,499 | 12/1902 | Gouy | 132/276 |
| 2,209,697 | 7/1940 | Kislingbury et al. | 132/279 |
| 2,403,601 | 7/1946 | Jackson | 132/277 |
| 2,637,328 | 5/1953 | Behr | 132/278 |
| 3,247,852 | 4/1966 | Schneider | 132/277 |
| 3,540,491 | 11/1970 | Solomon . | |
| 3,590,830 | 7/1971 | Hannum | 132/277 |
| 3,662,767 | 5/1972 | Murtha . | |
| 3,998,233 | 12/1976 | Dorr | 132/279 |
| 4,671,302 | 6/1987 | Hill . | |
| 5,109,878 | 5/1992 | Kuo-Hua . | |
| 5,181,530 | 1/1993 | Chou . | |
| 5,302,440 | 4/1994 | Davis . | |
| 5,335,680 | 8/1994 | Moore | 132/276 |

*Primary Examiner*—Gene Mancene
*Assistant Examiner*—Pedro Philogene
*Attorney, Agent, or Firm*—Breneman & Georges

[57] ABSTRACT

A hair clip includes a pair of clamping arms hinged together at an end thereof to define the clamping means of the hair clip. The clamping arms are moveable between a first open position wherein hair may be inserted or removed from the hair clip and a second closed position wherein hair is secured between the arms of the hair clip. The invention is directed to an alternating sequence of rubber teeth secured to the inner surface of each clamping arm which are in an interlocking mating relationship providing for a greater surface area between the clamping arms of the hair clip for better grasping and holding fine hair in place when the hair clip is in the closed position. A fastening clasp is provided opposite the hinge end of the clip for releasably maintaining the hair clip in the closed position.

3 Claims, 2 Drawing Sheets

HAIR CLIP

This application was disclosed in provisional application 60/052,662 filed Jul. 16, 1997.

BACKGROUND AND SUMMARY OF THE INVENTION

This invention relates generally to hair accessories, and more particularly to an improved hair clip which securely grasps and holds fine hair in place. The hair clip consists of a pair of clamping arms hinged together at an end thereof which are moveable between a first open position wherein hair may be inserted within the clamping arms of the hair clip and a second closed position wherein hair is grasped between the clamping arms of the hair clip. A fastening mechanism is provided opposite the hinge end of the hair clip for releasably maintaining the hair clip in the closed position. The invention is directed to an alternating sequence of rubber teeth secured to the interior surface of each clamping arm. Specifically, the rubber teeth of the clamping arms are staggered as to achieve an interlocking mating relationship when the hair clip is in the closed grasping position, providing for a hair clip which has much better gripping characteristics than does the conventional style hair clip.

During the thirteen years that the inventor has been a hairstylist, she has received many complaints from her clients who have been unable to find a barrette that will securely grasp and hold fine hair in place, this being true for adults with fine hair, but more so for children's extremely fine hair, the problem being that such fine hair would have a tendency to slip through the clamping arms. It was found, however, that during the hair coloring process, when wearing surgical gloves which were made of rubber, the customer's hair would unintentionally be pulled if the hairstylist was not careful when handling the hair due to the increased friction between the rubber and the hair. This led to the idea of a barrette using rubber inserts on the clasp to secure the hair. This type of hair barrette was experimented with in the hair of the daughter of the inventor, and her hair did not slip through the rubber clasp. The barrette remained in place until it was intentionally removed.

The present invention aims to alleviate the problems associated with traditional metal clamping arm barrettes, namely, of constantly having to reposition the barrettes for people with fine hair. The closest prior art to which the applicant is aware is U.S. Pat. No. 5,109,878 issued to Kuo-Hua. This reference discloses a hair clip designed to alleviate the problem of fine hair not being held securely. The clip uses small pins and opposing dimples made of metal. However, there is no teaching in this reference of the interlocking rubber teeth as shown in the instant invention, which is believed to represent a significant advancement in the art because it is safer, easier, more effective and comfortable to use, and more economically feasible.

The instant invention relates to a hair clip comprising a pair of clamping arms hinged together to define the clamping arms of the hair clip. The clamping arms are moveable between a first open position, wherein hair may be inserted or removed from the hair clip, and a second closed position, wherein hair is secured between the clamping arms of the hair clip. Specifically, the invention is directed to an alternating or staggered sequence of rubber teeth located at the inner surface of each metal clamping arm for more securely holding the hair strands between the clamping arms when the hair clip is in a closed position. The rubber teeth are molded to the upper clamping arm and encapsulate the lower clamping arm. The rubber teeth run at right angles to the length of each clamping arm and are in an interlocking mating relationship with each other when the hair clip is moved to the closed position. A fastening clasp is provided opposite the hinge end of the clip for releasably maintaining the hair clip in the closed position.

Accordingly, among the several objects of the instant invention are: the provision of a hair clip that will securely grasp and hold fine hair in place; the provision of a hair clip that is especially suitable for use with young children; the provision of a hair clip that does not need to be readjusted after its original positioning within the users hair; the provision of a hair clip having an alternating sequence of rubber teeth which are in an interlocking mating relationship when the clip is in a closed position; the provision of a hair clip that is safe and easy to use; and the provision of a hair clip that is cost efficient and easy to manufacture. Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE PROFFERED EMBODIMENTS

Figure 1:
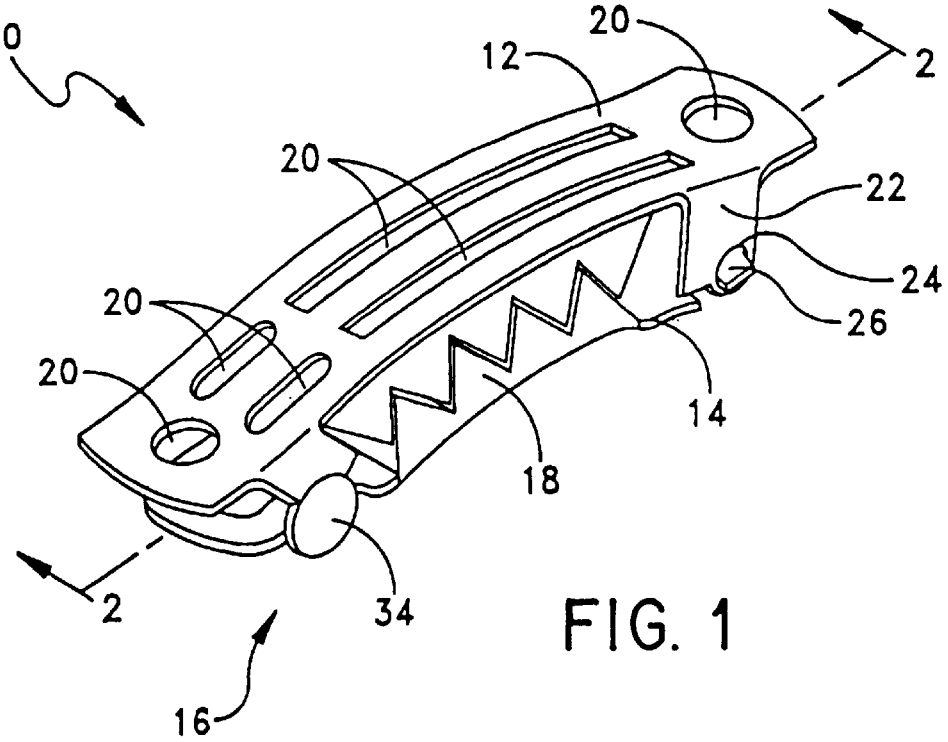
FIG. 1 is a perspective view of the hair clip of the instant invention.

Referring now to the drawings, and more particularly to FIG. 1, the hair clip of the instant invention is shown and generally indicated at 10. As will hereinafter be more fully described, the instant invention provides for a superior grip hair clip having an alternating sequence of rubber teeth secured to the interior surface of opposing clamping arms of the hair clip which provide a non-slip surface for more effectively grasping and holding fine hair in place. The hair clip is particularly effective for use with young children, but may also be used by teenagers and adults alike having fine hair.

Figure 2:
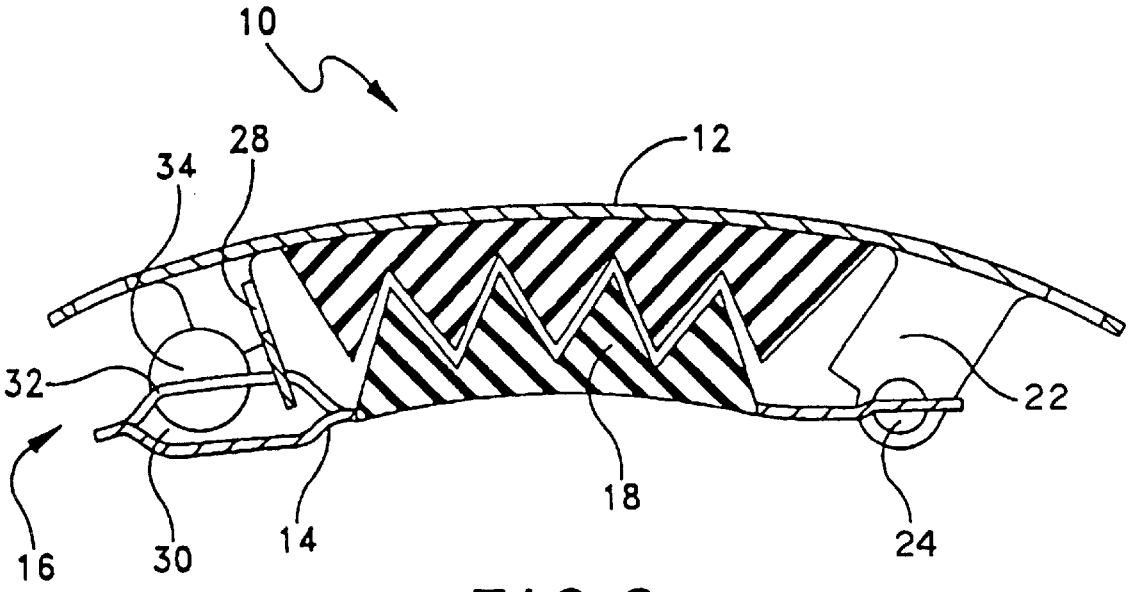
FIG. 2 is a cross-sectional view taken along line 2—2 of FIG. 1.

Referring to FIG. 1, the hair clip 10 as illustrated includes a curvilinear upper or first clamping arm 12 and a curvilinear lower or second clamping arm 14 hinged together at an end thereof and moveable between an open and a closed position. Opposite the hinge end of the clip 10 is a fastening mechanism generally indicated at 16 for releasably maintaining the hair clip 10 in a closed position. The invention is directed to an alternating sequence of rubber teeth 18 molded to the concave inner surface of the first clamping arm 12 support the first set of rubber teeth which intermesh with the second set of rubber teeth secured or molded to the convex inner surface of the lower clamping arm 14 of the hair clip 10 as illustrated in FIG. 2 mentioned above, the rubber surface provides a non-slip surface at the interior of the clamping arms for securely maintaining hair between the clamping arms 12 and 14 of the hair clip 10 when same is in a closed position. Specifically, rubber teeth 18 have a pointed apex and linear sloping sides and are disposed on the curvilinear inner surfaces of each clamping arm 12 and 14 are rubber teeth 18 of each clamping arm 12 and 14 are in an interlocking mating relationship when the hair clip 10 is moved to the closed position, as most clearly shown in FIG. 2. Each set of rubber teeth 18 is preferably a single unitary strip fabricated from a specially designed mold. It will be understood that the teeth 18 may be constructed of any resilient rubber-like material and may assume any desired undulating configuration.

Referring now to both FIGS. 1–2, each clamping arm 12 and 14 comprises a generally elongate flat body preferably fabricated from a metal material. The first clamping arm 12 has a plurality of openings 20 formed therein so that any desired ornaments (not shown) may be attached to the exterior side thereof for aesthetic reasons. Located at the hinge end of the first clamping arm 12 are a pair of oppositely disposed, downwardly extending ear portions 22 each having an aperture 24 formed therein for receiving a pair of hinge tabs 26 located at the adjacent end of the second clamping arm 14. More specifically, the hinge tabs 26 ride in the ear apertures 24 thereby providing pivot points for the hinge mechanism of the instant hair clip 10. However, it should be understood that any suitable hinge mechanism may be used with the hair clip and still fall within the scope of the present invention.

Located at the fastening end 16 of the first clamping arm 12 are a pair of clasp hooks 28 which are snap received within a clasp slot 30 formed in the second clamping arm 14 for releasable maintaining the hair clip 10 in the closed position. Specifically, the clasp hooks 28 engage slot rails 32 of the clasp slot 30 when clamping arms 12 and 14 are pressed together to move the hair clip 10 to the closed position. A pair of squeeze tabs 34 are in communication with the clasp hooks 28 for releasing the clamping arms 12 and 14 of the hair clip 10 from their closed position. Specifically, the clasp hooks 28 are normally biased outwardly, however, when clamping arms 12 and 14 are moved to their closed position, the clasp hooks 28 are forced inwardly and snap engage within the clasp slot 30 to releasably maintain the hair clip in the closed position. It will be understood that the aforesaid hinge and fastening means are well known in the prior art and per se form no part of the instant invention.

Figure 3:
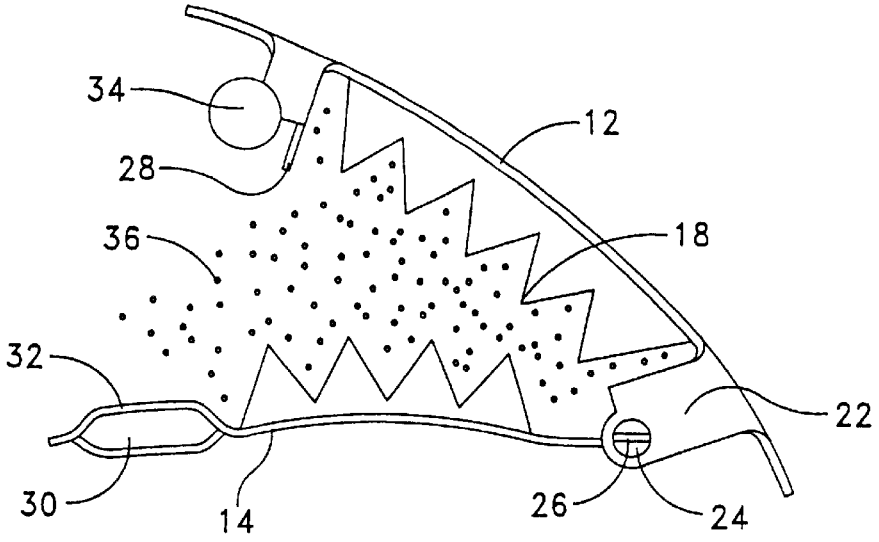
FIG. 3 is a side view illustrating the hair clip in an open position.
Figure 4:
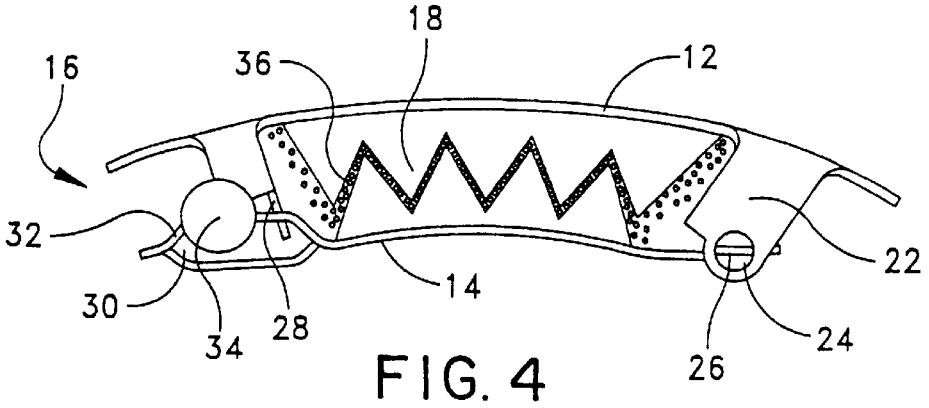
FIG. 4 is a side view illustrating the hair clip in a closed position.

Referring now to FIGS. 34, the hair clip 10 is shown respectively in both an open and a closed position. First, referring to FIG. 3, the hair clip 10 is shown in an open position with a plurality of hair strands 36 depicted in a loosely bundled condition between the clamping arms 12 and 14 of the hair clip 10. FIG. 4, depicts the hair clip 10 in a closed position showing the plurality of hair strands 36 bunched together and trapped between the clamping arms 12 and 14 the hair clip 10. Specifically, FIG. 4 illustrates the sequence of rubber teeth 18 run at right angles to the length of each clamping arm to evenly divide and divide and distribute while providing a greater surface area within the clamping arms of the hair clip for more effectively grasping and holding hair strands 36 with an even tension on hair strands disposed transversely to the longitudinal arc of the curvilinear clamping arms when the hair clip 10 is in the closed position. More specifically, the conventional metal-style barrette having a third U-shaped arm located between the upper and lower clamping arms has a surface area contact of 0.054 square inches between the middle and upper and lower arms. The hair clip of the instant invention eliminates the middle clamping arm present in the conventional style barrette and has a greater surface area contact of 0.6432 square inches between the opposing rubber teeth of the upper and lower clamping arms. This arrangement provides for an increased surface area contact of 0.5892 square inches. The combination of the rubber clamping teeth 18 and increased surface area provided by the angled surfaces of the clamping rubber teeth provide for a hair clip 10 which better maintains fine hair at the desired clamping position.

Figure 5:
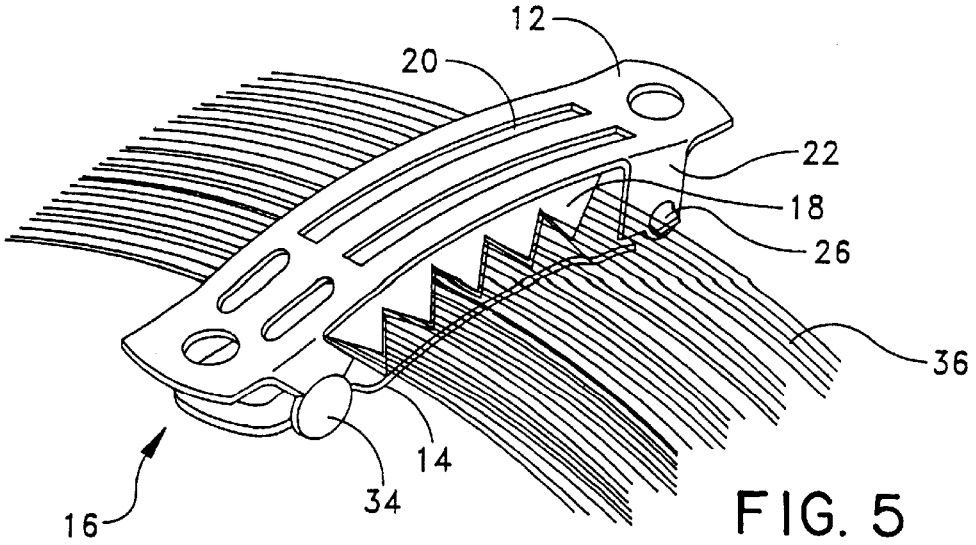
FIG. 5 is a perspective view illustrating the hair clip in use.

In use, the hair clip 10 is released to the open position and positioned at the desired location within the user's hair. The clamping arms 12 and 14 may then be pushed together which automatically closes the fastening mechanism 16 for securely retaining the hair strands 36 between the clamping arms of the clip 10 at the desired location within the user's hair. As shown in FIG. 5, the hair strands 36 extend from each side of the hair clip 10 when same is in the closed position. Specifically, the resilient clamping rubber teeth allows for the hair strands 36 to fit between the clamping arms 12 and 14 of the clip 10 in a comfortable manner when same is in the closed position. More Specifically, the hair strands 36 are comfortably received between the clamping arms of the hair clip because the triangular shaped clamping rubber teeth having a pointed apex evenly divide and distribute hair between the teeth so that the pulling pressure is on all of the hair strands received between the clamping arms and not just a few strands. In other words, there is an even tension on the hair strands which are gripped between the clamping arms of the hair clip when the teeth are closed and staggered with respect to each other in an interlocking mating relationship as illustrated in FIG. 4. It should be understood that any number of desired ornamental members may be attached to the exterior surface of the first clamping arm giving the hair clip a more desirable and individually pleasing appearance.

It can therefore be seen that the instant invention provides for a hair clip that more effectively grasps and holds fine hair in place. The hair clip has a pair of opposing clamping arms having an alternating sequence of rubber teeth molded or otherwise secured therein which provide for a non-slip surface for securely gripping hair when the clip is in a closed position. The hair clip effectively holds its originally clamped position thus eliminating the need of continuous readjustment associated with conventional designed hair clips. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A hair clip comprising:

(a) a pair of elongated curvilinear metallic clamping arms having oppositely disposed curvilinear inner surfaces, said pair of elongated curvilinear metallic clamping arms hinged together at one end thereof and being movable between a first open position wherein the hair of a user may be inserted between said curvilinear inner surfaces with the hair extending transversely to the curvilinear longitudinal arc of said pair of elongated curvilinear metallic clamping arms, and a second closed position wherein the hair is secured between said pair of elongated curvilinear metallic clamping arms;

(b) fastening means mounted at the opposite end of said pair of elongated curvilinear metallic clamping arms operable for releasably maintaining said pair of elongated curvilinear metallic clamping arms in their closed position; and (c) a non-slip rubber-type strip formation secured to each of said curvilinear inner surfaces and extending for substantially the distance between the hinged end of said pair of elongated curvilinear metallic clamping arms and said fastening means, said non-slip rubber-type formation having a plurality of transversely extending triangular shaped teeth having a pointed apex for evenly dividing strands of hair and linear sloping sides extending from said curvilinear inner surfaces for providing an even tension on strands of hair engaged between said triangular shaped teeth when the clip is closed and said triangular shaped teeth are staggered with respect to each other and in an interlocking mating relationship.

2. The hair clip of claim 1 wherein the upper arm of said pair of elongated curvilinear metallic clamping arms has a concave inner surface and the lower arm has a convex inner surface.

3. The hair clip of claim wherein said triangular shaped teeth provide a greater surface area contact.

* * * * *